United States Patent [19]

Eberly

[11] Patent Number: 4,506,528

[45] Date of Patent: Mar. 26, 1985

[54] SECURITY DEVICE FOR PADLOCKS

[76] Inventor: David S. Eberly, 5407 Touraine Dr., Tallahassee, Fla. 32308

[21] Appl. No.: 503,029

[22] Filed: Jun. 10, 1983

[51] Int. Cl.[3] ..... E05B 73/00; E05B 67/38

[52] U.S. Cl. ..... 70/18; 70/54

[58] Field of Search ..... 70/54–56, 70/14, 18, 33, 57

[56] References Cited

U.S. PATENT DOCUMENTS

| | | | |
|---|---|---|---|
| 3,884,057 | 5/1975 | Maurer | 70/54 X |
| 4,294,088 | 11/1981 | Barr | 70/56 |
| 4,322,102 | 3/1982 | Lindblom | 70/56 X |
| 4,413,488 | 11/1983 | Harmison, Jr. | 70/57 |

FOREIGN PATENT DOCUMENTS

| | | | |
|---|---|---|---|
| 877027 | 8/1971 | Canada | 70/54 |
| 413366 | 4/1946 | Italy | 70/55 |

*Primary Examiner*—Gary L. Smith
*Assistant Examiner*—Thomas J. Dubnicka
*Attorney, Agent, or Firm*—Eugene C. Knoblock

[57] ABSTRACT

This security device is designed for padlocks, so as to prevent their shackle members from being cut by a bolt cutter or a hacksaw. Primarily, it consists of a main body, which nestles the padlock, and which leaves no room for the operation of a bolt cutter or hacksaw to remove it from the assembly. The assembly further includes a strap for engaging with whatever is to be locked, and it includes a clevis pin for retaining the assembly together, in combination with the lock.

1 Claim, 4 Drawing Figures

SECURITY DEVICE FOR PADLOCKS

This invention relates to locks, and more particularly, to a security device for padlocks.

The principal object of this invention is to provide a security device for padlocks, which will protect the shackle of a common padlock from being accessible to a bolt cutter, thus deterring theft.

Another object of this invention is to provide a security device for padlocks, which will be particularly adaptable for preventing the theft of farm tractors and heavy equipment.

Another object of this invention is to provide a security device for padlocks, which will be employed around clutch and shift levers, steering levers, and around security gates, so as to prevent theft.

A further object of this invention is to provide a security device for padlocks, which will include a member for receiving the shackle of a padlock, so as to prevent a bolt cutter or other tool from being used to cut the shackle.

Other objects are to provide a security device for padlocks, which is simple in design, inexpensive to manufacture, rugged in construction, easy to use, and efficient in operation.

These, and other objects, will be readily evident, upon a study of the following specification, and the accompanying drawing, wherein.

Figure 1:
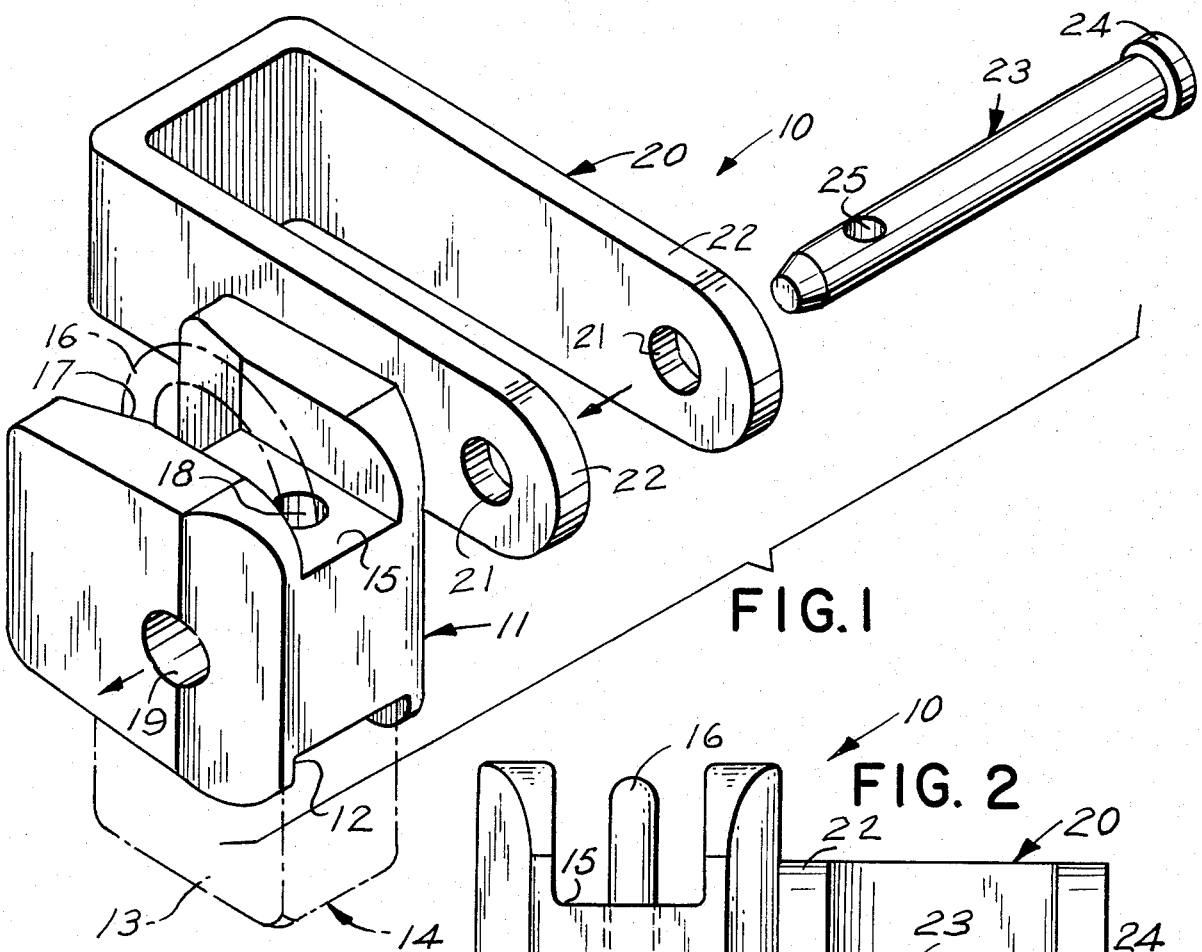
FIG. 1 is an exploded perspective view of the present invention, illustrating a padlock in phantom lines.
Figure 2:
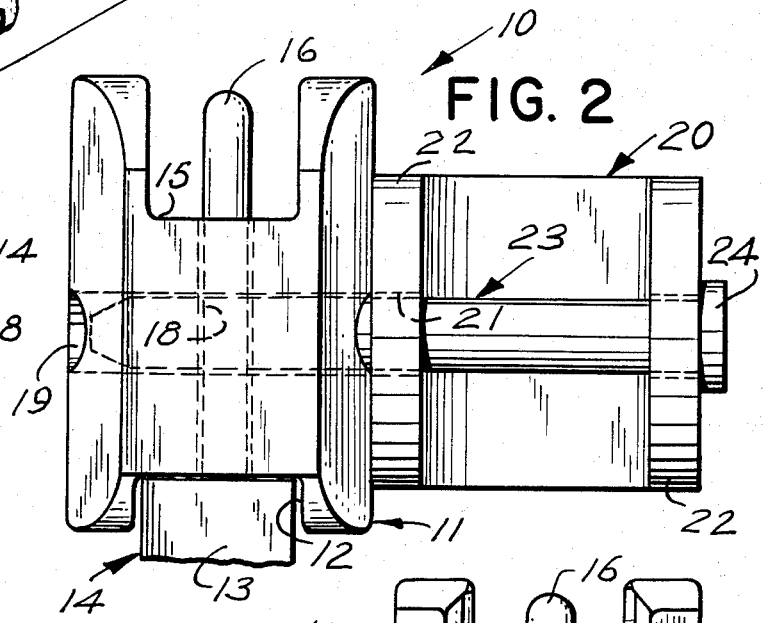
FIG. 2 is a front elevational view of FIG. 1, shown assembled, and illustrating the padlock fragmentary.

Accordingly, a device 10 is shown to include a main body 11, which is a metal casting, having a bottom recessed opening 12, for receiving the body 13 of a padlock 14. A recessed opening 15, in the top of main body 11, serves to confine the shackle 16 of lock 14 closely, so as to prevent a would-be perpetrator from employing a bolt cutter or hacksaw to sever shackle 16. The rear side of main body 11 also includes a recessed opening 17, for receiving one leg portion of the shackle 16 of padlocks 14, and a vertical opening 18, through main body 11, freely receives the other leg portion of shackle 16. A horizontal opening 19 extends through main body 11, and intersects with opening 18, for a purpose which hereinafter will be described.

A "U"-shaped strap 20, of case hardened steel, includes aligned openings 21 through the ends of its leg portions 22, for freely receiving a case hardened steel clevis pin 23, having a head 24 and a transverse opening 25. Opening 25 freely receives the shackle 16 of padlock 14, and pin 23 is received in horizontal opening 19 of main body 11. The strap locks around anything to be locked, such as clutch, steering levers, or a security gate, and the shackle, when received through opening 18 of main body 11, and simultaneously, through opening 25 of clevis pin 23, renders the combination stationary against each other, and it shall be noted, that the shackle is also case hardened, as well as strap 20, and pin 23, so as to prevent them from being hacksaw cut, or severed by bolt cutters.

In use, strap 20 is placed on whatever is to be locked, and clevis pin 23 is inserted into the openings 20 thereof. The main body 11 is then pushed onto pin 23 by its opening 19, after which, the lock body 13 is placed in opening 12 of main body 11, and the shackle 16 is urged downwards in the openings 18 of main body 11, and through the opening 25 of pin 23, which locks the padlock 14, and thus locks main body 11, strap 20, and pin 23 together as an assembly.

Figure 4:
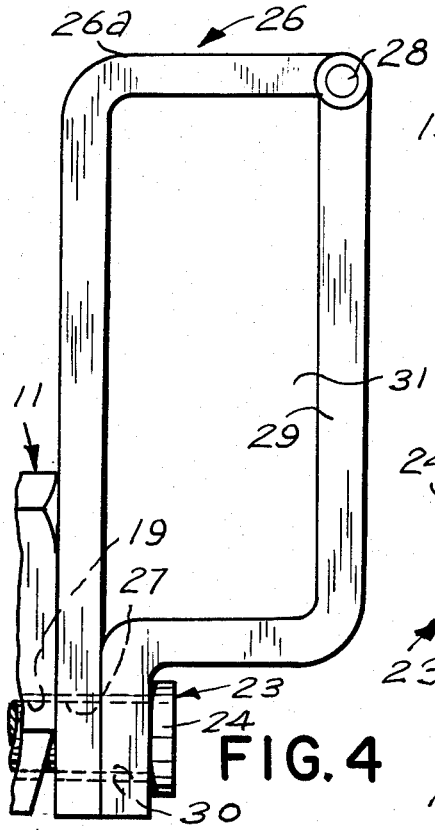
FIG. 4 is a top plan view of a modified form of the strap, which illustrates the main body of the device fragmentary.
Figure 3:
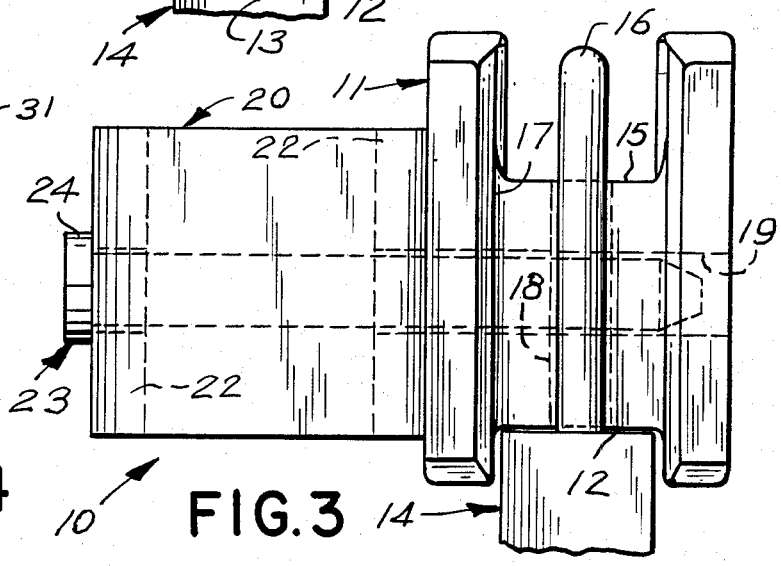
FIG. 3 is a rear view of FIG. 2.

Referring now to FIG. 4, a modified form of strap 26 is shown to include a main bar **26*a* of "L"-shaped configuration, which includes an opening 27 at one end, and a hinge pin 28 at its opposite end. Hinge pin 28 secures one end of arm 29 to main bar 26*a*, and the opposite end of arm 29 includes an opening 30, which aligns with opening 27 of bar 26*a*, so as to receive clevis pin 23. Arm 29 serves to confine anything that is to be locked within the opening 31, defined by main bar 26*a* and arm 29, and leaves no exposure of clevis pin 23** for possible cutting attempts.

In use, the function of main body 11, padlock 14, modified strap 26, and clevis pin 23 are similar to the aforedescribed, of the combinations of 11, 14, 20 and 23, with the exception, that modified strap 26 is a hinged element, which opens pivotally to lock around an article, and it presents no exposure for the pin 23 of the combination to cutting tools.

While various changes may be made in the detail construction, it is understood that such changes will be within the spirit and scope of the present invention, as is defined by the appended claims.

I claim:

1. A device for protectively locking one member against movement relative to a second member by means of a padlock having a U-shaped hasp and a body, comprising a solid metal retainer carried by one member and having recesses in opposite faces and one intervening face thereof and passages extending therethrough and intersecting within the retainer, a second retainer carried by the other member, and a pin connecting said retainers and extending into a passage of said first retainer, said pin having a transverse opening located at the intersection of said passages of said first retainer to receive a portion of said padlock hasp extending into the passage of said first retainer which intersects said pin, the remaining portions of said hasp and at least part of said padlock body fitting in the recesses of said first retainer when said hasp portion and pin intersect.

* * * * *